United States Patent [19]

Brisson

[11] 3,958,895

[45] May 25, 1976

[54] PUMP WITH SHEARING MEANS

[76] Inventor: Leonard L. Brisson, 2359 E. Cowern Place, North St. Paul, Minn. 55109

[22] Filed: Feb. 7, 1975

[21] Appl. No.: 547,935

[52] U.S. Cl. ..... 415/121 B; 415/98; 417/234; 415/219 C

[51] Int. Cl.[2] ..... F04D 29/70

[58] Field of Search ..... 417/234; 415/98, 121 B, 415/219 C

[56] References Cited

UNITED STATES PATENTS

| | | | |
|---|---|---|---|
| 2,265,758 | 12/1941 | Klosson | 415/121 B |
| 2,383,424 | 8/1945 | Stepanoff | 415/98 |
| 3,371,614 | 3/1968 | Crisafulli | 417/234 |
| 3,692,422 | 9/1972 | Girardier | 415/121 B |
| 3,721,504 | 3/1973 | Crisafulli | 415/121 B |

FOREIGN PATENTS OR APPLICATIONS

| | | | |
|---|---|---|---|
| 1,013,787 | 5/1952 | France | 415/121 B |

*Primary Examiner*—Henry F. Raduazo
*Attorney, Agent, or Firm*—Berman, Aisenberg & Platt

[57] ABSTRACT

A pump having a volute housing containing a rotor having a plurality of vanes. Two opposite vanes have opposing axially extending shear blade portions at their inner ends which project into the pump intake openings in the opposite side walls of the volute housing and which co-operate with radially extending shear bars secured externally on the side walls of the volute housing and extend over the housing intake openings, to cut up all types of debris entering the pump and to thereby prevent clogging of the pump.

8 Claims, 8 Drawing Figures

PUMP WITH SHEARING MEANS

This invention relates to liquid pumps, and more particularly to a submersible pump for use in drainage operations, and the like, or for other similar tasks requiring the pumping and circulation of large volumes of liquids likely to contain debris such as solid matter, branches or twigs, or other trash material.

A main object of the invention is to provide a novel and improved drainage pump which is simple in construction, which is convenient to operate, and which is provided with means for cutting up solid matter and all types of debris and trash material in the liquid entering the pump to thereby prevent clogging of the pump.

A further object of the invention is to provide an improved portable drainage pump assembly which is sturdy in construction, which is easy to transfer from one location to another where its use is desired, and which is provided with externally mounted shear bar means for cutting up debris, solid and trash material contained in the water entering the pump, whereby to avoid clogging up of the pump by such material and to maintain the efficiency of the pump in spite of the presence of quantities of such foreign material in the water being drained.

A still further object of the invention is to provide an improved submersible pump of the centrifugal type, the pump being provided with means to shear various types of foreign material entering the pump and to cut up such material so that the pump can handle the intended discharge without becoming clogged up or losing efficiency, this shearing action taking place at the exterior portion of the pump and not in the interior thereof, whereby the pump impellor blades will not become jammed by the foreign material entering the pump.

Further objects and advantages of the invention will become apparent from the following description and claims, and from the accompanying drawings wherein:

Figure 1:
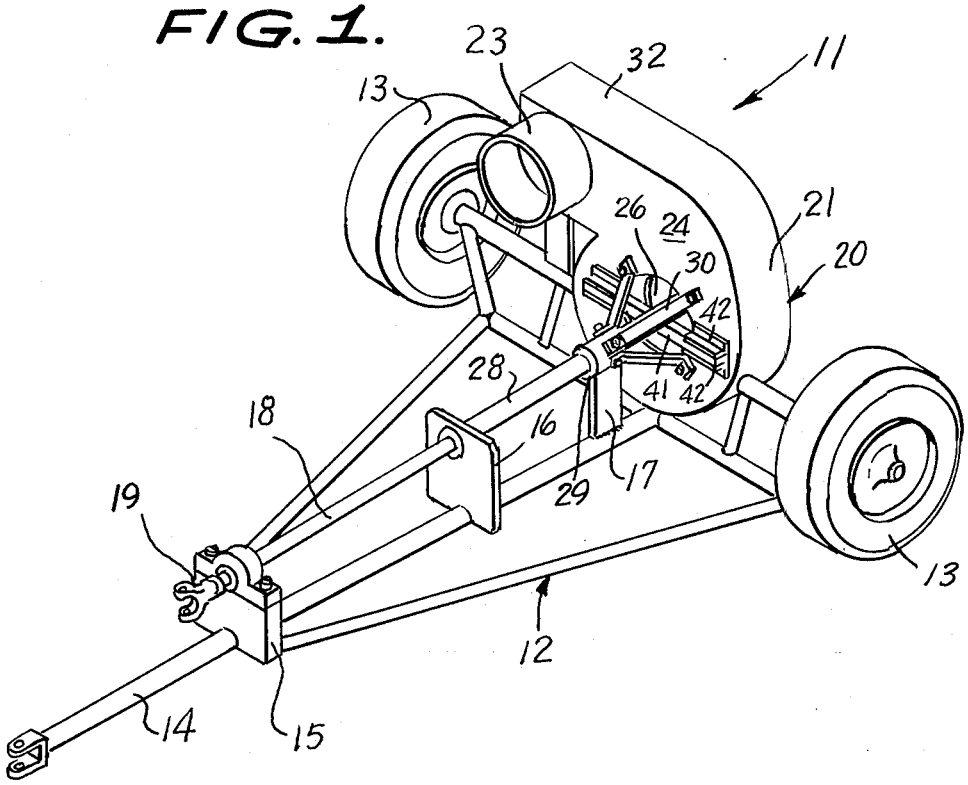
FIG. 1 is a perspective view of a typical portable drainage pump assembly constructed in accordance with the present invention.

Submersible pumps of the type contemplated by the present invention are often mounted in a manner permitting them to be transported readily, for example, on a wheeled frame, and are adapted to be moved to locations to be drained of water, wherein the pump is substantially submerged in the water to be drained, and wherein this water usually contains twigs and similar debris. Thus, there is a serious problem of clogging the pump during operation thereof because of the entry into the pump of such twigs or other debris, which is caught in the pump and tends to jam the pump rotor blades. A prime purpose of the present invention is to provide means which can be relied upon to cut up the debris entering the pump and to reduce it in size sufficiently so that it can be easily handled by the pump without clogging the pump or reducing its efficiency. The present invention further aims to provide this shearing action externally of the pump working region so that the material cut up by the shearing action cannot interfere with the normal action of the pump. In contrast to this, if the shearing action were performed inside the pump, there is a definite risk of the uncut trash material reaching the impeller blades before it has been cut up and thus tending to jam up the pump before the foreign material has been adequately reduced in size.

Referring to the drawings, 11 generally designates a typical improved draining pump assembly constructed in accordance with the present invention. The pump assembly 11 comprises a wheeled frame, designated generally at 12, having the ground-engaging wheels 13, 13, and having a draw bar 14 which can be attached to a suitable pulling vehicle such as a tractor, or the like.

The supporting frame 12 further includes upstanding bearing support means, such as a forward pillow block 15, an upstanding transverse supporting plate 16 and an upstanding supporting bar 17, provided with suitable bearing means for rotatably receiving and supporting a pump driving shaft 18 provided at its forward end with suitable coupling means 19 for connecting the shaft to the power take off means of a tractor or similar associated power means.

Designated generally at 20 is a centrifugal pump comprising a transversely mounted volute housing 21 suitably secured on the rear framework panel of the supporting frame 12 and having a tangentially extending outlet duct 22 provided with a suitable forwardly extending connection collar portion 23 adapted to be connected to a conventional long flexible discharge conduit, not shown, for conveying drainage liquids to a suitable remote location.

Figure 5:
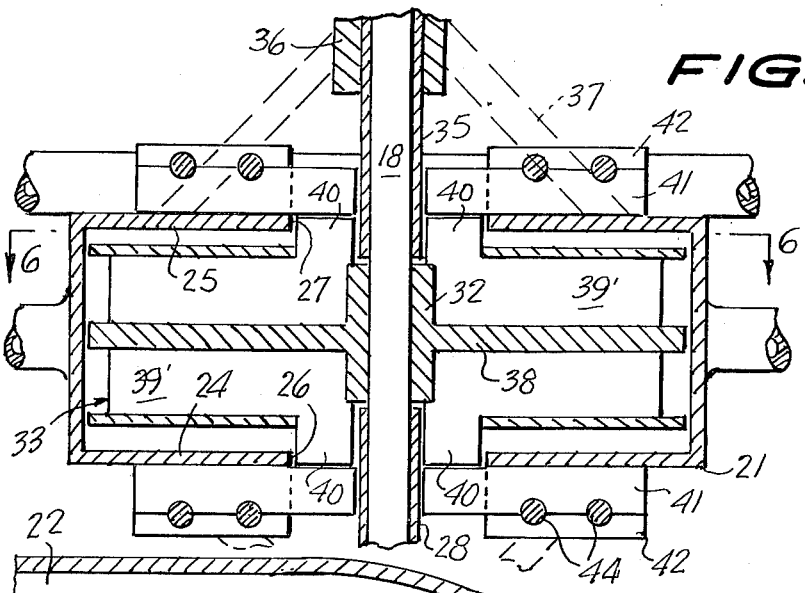
FIG. 5 is an enlarged horizontal cross-sectional view taken substantially on a line 5—5 of FIG. 4.

The volute housing 21 is provided with front and rear main walls 24 and 25 having circular central intake openings 26 and 27. Secured to the upstanding supporting members 16 and 17 is an elongated shaft bearing sleeve 28 which is secured in a base sleeve 29 provided on the top end of upstanding bar member 17 which is braced to the front wall 24 of the volute housing by a plurality of angularly spaced inclined strut bars 30. As shown in FIG. 5, the bearing sleeve 28 projects into the volute housing through the opening 26 and terminates adjacent the hub 32 of the pump rotor assembly, designated generally at 33. The rear portion of the driving shaft 18 is similarly supported in a bearing sleeve 35 which is externally supported adjacent the rear wall 25 of the volute housing 21 substantially in the same manner as the forward bearing sleeve 28, the rear bearing sleeve 35 also projecting into the intake opening 27 and terminating adjacent the rotor hub 32, as shown in FIG. 5.

The forward portion of the rotor shaft bearing sleeve 28 is suitably secured rigidly in the top portion of the upstanding transversely extending support plate 16.

Figure 2:
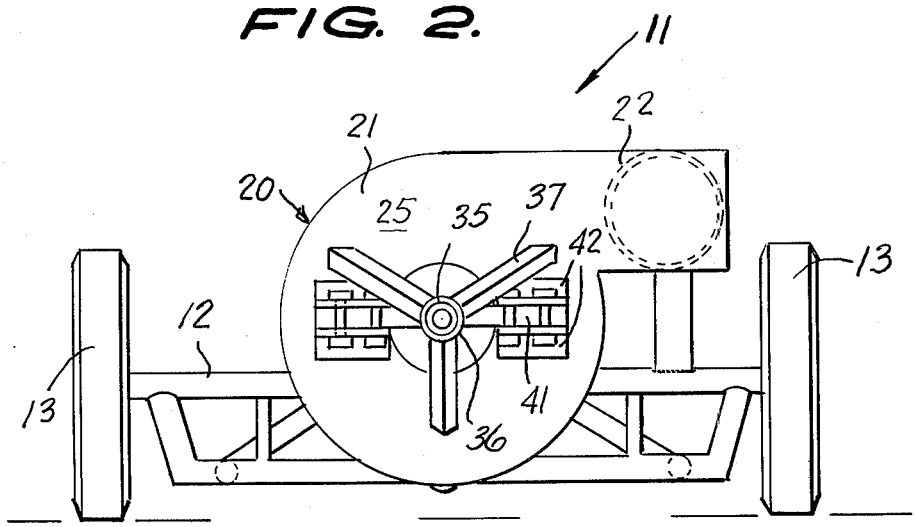
FIG. 2 is a somewhat enlarged rear elevational view of a portable drainage pump assembly similar to that shown in FIG. 1.
Figure 3:
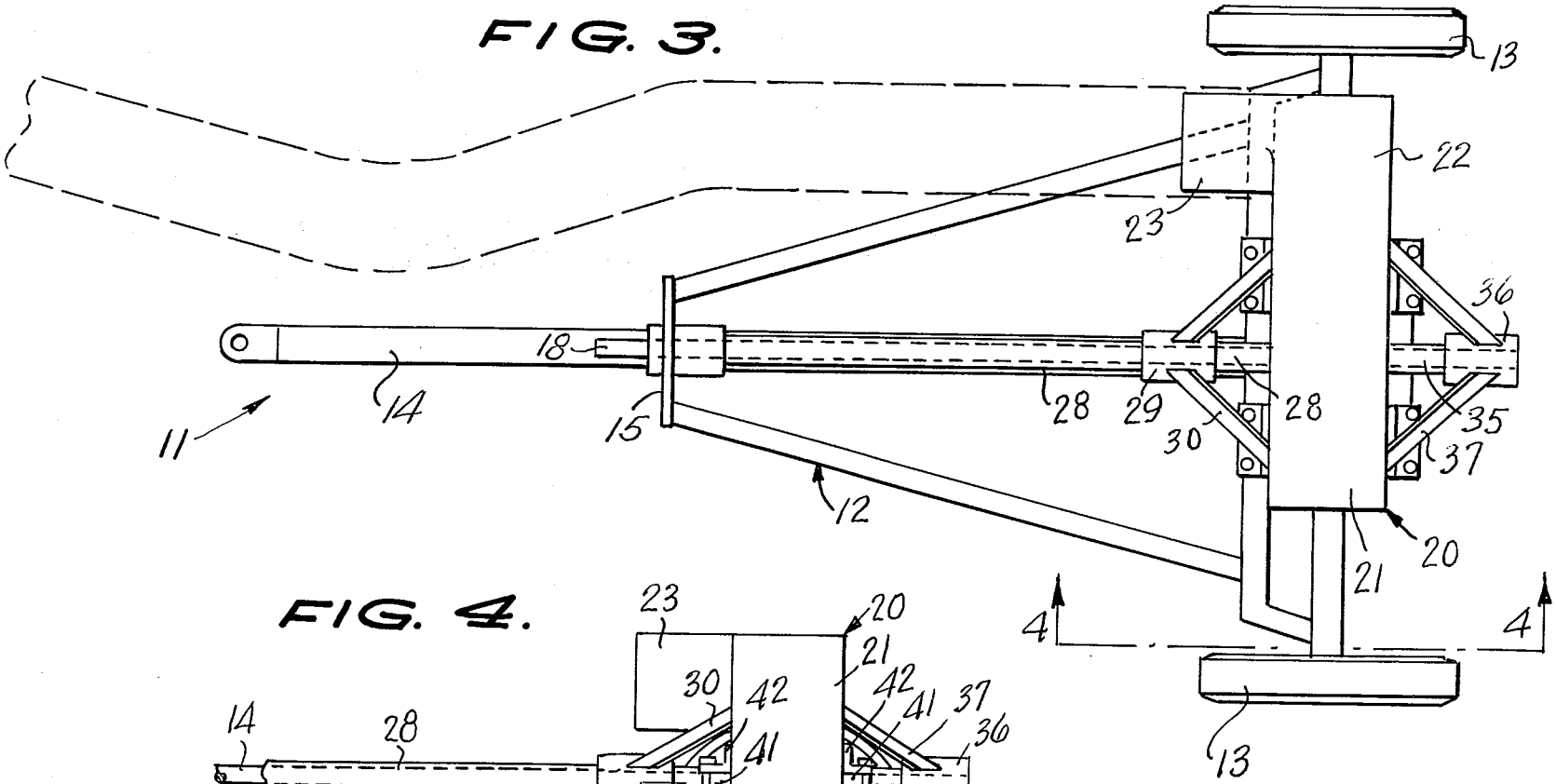
FIG. 3 is a top plan view of the pump assembly of FIG. 2.
Figure 4:
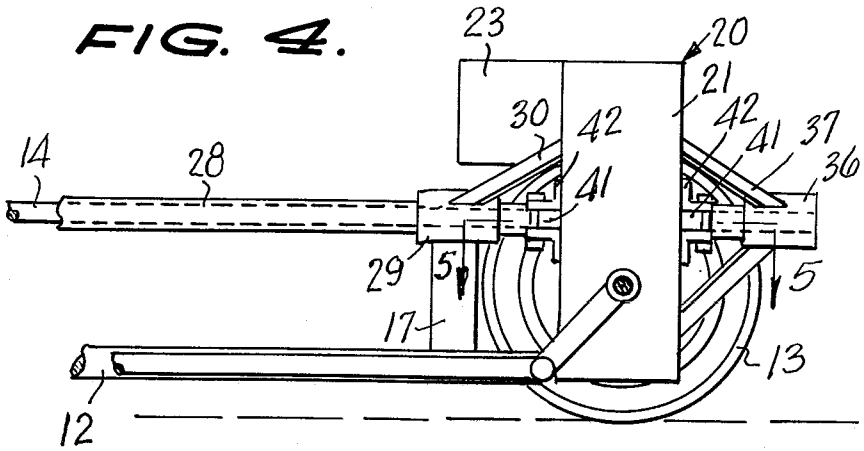
FIG. 4 is a fragmentary vertical cross-sectional view taken substantially on a line 4—4 of FIG. 3.

Rear bearing sleeve 35 is secured in a supporting collar portion 36 which is braced to the rear wall 25 of volute housing 21 by angularly spaced inclined strut bars 37, as shown in FIG. 2.

Figure 7:
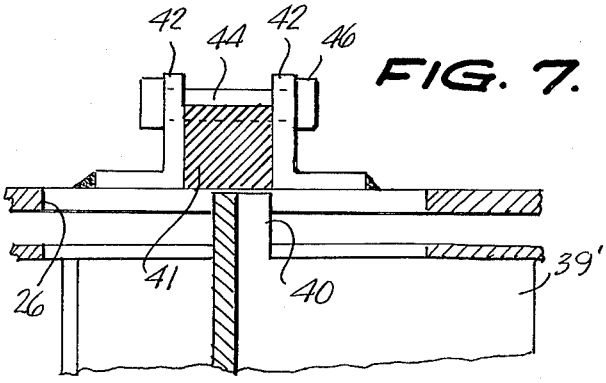
FIG. 7 is an enlarged fragmentary vertical cross-sectional view taken substantially on a line 7—7 of FIG. 6.
Figure 8:
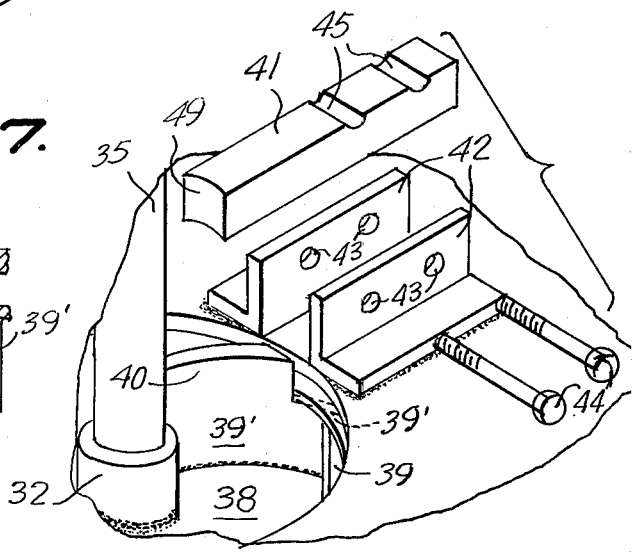
FIG. 8 is a fragmentary exploded perspective view showing a portion of the side wall of the pump housing of the assembly of FIGS. 1 to 7, the portion being adjacent to an intake opening of the pump, the view illustrating the parallel shear bar bracket members and associated bolts and the associated shear bar in position to be secured between the bracket members.

The pump impeller, or rotor, designated generally at 33, comprises a main transverse supporting web 38 and a plurality of arcuately curved vanes 39 extending on opposite sides of the web 38 and being rigidly supported thereby. The web 38 is integrally formed with the hub portion 32, as shown in FIG. 5. A pair of diametrically opposed vanes 39', 39' are integrally formed with respective extensions, or blades, 40 extending into the circular intake openings 26 and 27, and terminating adjacent the outside planes of the housing side walls, 25, 24. The extensions 40 have outer edges extending adjacent to and adapted to shearingly co-operate with respective shear bars 41 rigidly secured to the outside surfaces of the housing walls 24, 25 and extending radially toward and terminating closely adjacent to the respective shaft bearing sleeves 28 and 35. Thus, the opposite side walls 24 and 25 are provided with respective pairs of spaced parallel bracket bars 42, 42, which may comprise angle bars, as shown in FIG. 8, spaced to receive therebetween a shear bar 41, and having bolt holes 43 to receive securing bolts 44 which are lockingly receivable in transverse grooves 45, 45 provided on the respective shear bars 41. The fastening bolts 44 are provided with suitable clamping nuts 46, as shown in FIG. 7. As shown in FIG. 8, the inner ends of the shear bars 41 are suitably contoured arcuately, as shown at 49, to conform to the contour of the bearing sleeves 28, 35.

Figure 6:
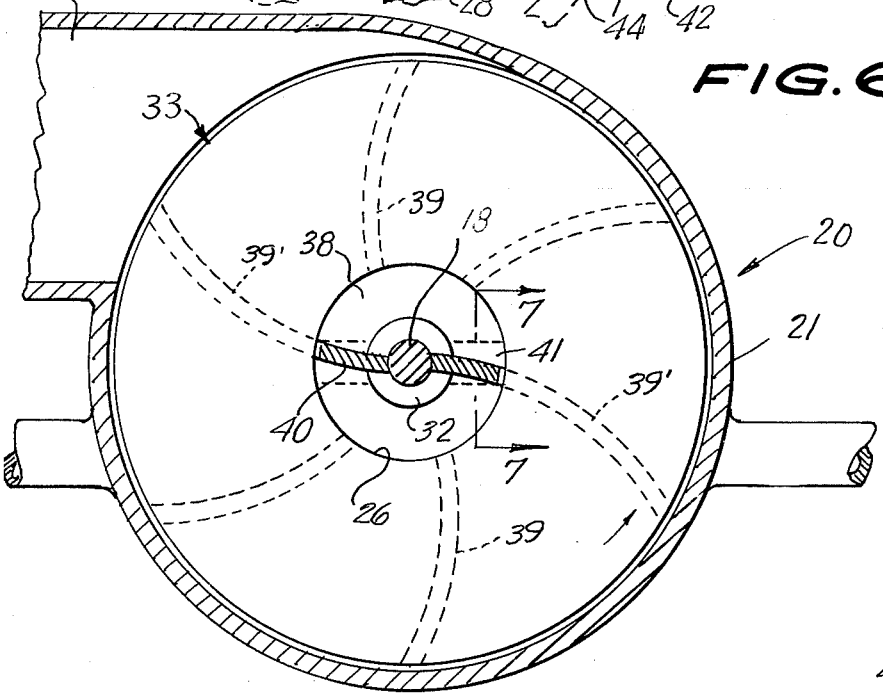
FIG. 6 is a vertical cross-sectional view taken substantially on a line 6—6 of FIG. 5.

In operation, the pump assembly 11 is suitably submerged in an area to be drained, such as a marsh, or similar area, with the intake openings 26, 27 preferably below the water level so as to allow water to enter the pump 20. The driving shaft 18 is suitably connected to a power means, such as to the power take-off shaft of a tractor, as above mentioned, or to any other suitable power means. A sufficiently long discharge conduit is connected to the outlet, 23, to lead the drained water to a desired remote location to which it is to be transferred. As the impeller 33 is rotated by its drive shaft 18, rotating in a counter-clockwise direction, as viewed in FIG. 6, water is drawn into the volute housing through the intake openings 26, 27 and is discharged through the tangential outlet conduit portion 22. Twigs or other debris drawn toward the intake openings are shearingly engaged between the extensions 40 and the shear bars 41 before they enter the volute housing and are thereby cut up into relatively small pieces, sufficiently small so as not to jam or interfere with the action of the impeller vanes. Thus, the foreign material, such as the aforesaid twigs or other debris, is so chopped and cut up that the pump can handle the discharge without becoming clogged or losing efficiency. As above mentioned, the shearing action takes place at the outside edge of the pump housing and not in the interior, thereby preventing the possibility of jamming the impeller blades before digesting the foreign material.

The shear bars 41 may have any desired cross-sectional shape, and are shown as being of rectangular cross-sectional shape, merely by way of example. Furthermore, any desired number of impeller vanes may be provided with the shearing extensions, or blades, 40. In a typical embodiment illustrated herein, such extensions have been shown as being provided on a pair of diametrically opposite impeller vanes.

It will be noted that the extensions 40 are of generally rectangular shape and rotatably fit in the intake openings 26, 27, with their outside edges moving closely adjacent to the shear bars 41, so as to have close shearing co-operation therewith.

While the above description has emphasized the use of the improved pump for draining and in connection with a wheeled frame, it should be recognized that the invention is applicable for many other uses and without such wheeled frame. For example, the improved pump may be used in connection with flooding, irrigation, sewage disposal, pumping sludge and liquid manure, etc. The pump as a vertical pump without the wheeled carriage, is adapted to be lowered into a sewer, a sludge or liquid manure pit.

While a specific embodiment of an improved pump assembly having means for cutting up various types of foreign material reaching the intake opening of the pump assembly has been described in the foregoing description, it will be understood that various modifications within the spirit of the invention may occur to those skilled in the art. Therefore it is intended that no limitations be placed on the invention except as defined by the scope of the appended claims.

What is claimed is:

1. A pump comprising support means, a volute housing mounted on said support means and having a tangentially extending outlet duct, said housing having opposed side walls and a central intake opening in at least one of said walls, a rotor including an axial shaft and vanes extending from said shaft, journal means including at least one fixed sleeve secured to said support means and rotatably receiving said shaft, said sleeve extending through said intake opening into said housing, blade means on said vanes extending axially and outwardly into said intake opening, and shear bar means secured externally to the housing and extending radially toward and ending adjacent said sleeve and overlying said intake opening so as to shearingly cooperate with said blade means during rotations of said rotor to cut up trash material entering the housing, said fixed sleeve preventing contact of soft, elongated and pliant pieces of trash with the rotating shaft to avoid tangling thereon and clogging of the pump.

2. The pump of claim 1, and wherein said volute housing has central intake openings at opposite sides thereof and wherein said vanes have blade means extending adjacent both intake openings and the housing is provided with externally secured shear bar means on said opposite sides extending radially toward said shaft means and overlying said intake openings so as to cooperate shearingly with said blade means.

3. The pump of claim 1, and wherein the housing is provided on its exterior adjacent each said intake openings with a pair of spaced parallel bracket elements defining a radial seat and wherein said shear bar means comprises a bar element disposed in each said seat, and means to lock the bar element in said seat with the bar element extending radially over said opening toward said shaft means.

4. A pump comprising support means, a volute housing mounted in said support means and having a tangentially extending outlet duct and having opposite side walls, a central intake opening in each of said side walls, a rotor including axial shaft means and vane means extending from said shaft means, journal means rotatably supporting said rotor in the housing, blade means on said vane means extending as projections into each of said central intake openings, said housing being provided on its exterior adjacent each said intake opening with a pair of spaced parallel bracket elements defining a radial seat, shear bar means comprising a bar element disposed in each said seat, and means to lock each bar element in its seat with the bar elements extending radially over said openings toward said shaft means so as to shearingly cooperate with said blade means during rotation of said rotor to cut up trash material entering the housing.

5. The pump of claim 4, and wherein said journal means comprises respective journal sleeves secured to said support means and rotatably receiving said shaft means, said journal sleeves extending through said intake openings, said shear bars terminating adjacent said journal sleeves.

6. The pump of claim 5, and wherein respective external radial shear bars are provided diametrically opposite each other on the opposite sides of the volute housing extending inwardly over the intake openings and terminating adjacent the journal sleeves.

7. The pump of claim 6, and wherein the opposite sides of the housing are provided with respective pairs of parallel bracket members spaced to define radial seats to receive said shear bars, and respective bolt means extending through the pairs of bracket members and lockingly engaging the shear bars.

8. The pump of claim 7, and wherein said shear bars are provided with transverse grooves in their outer faces and wherein said bolt means lockingly interengage with said grooves.

* * * * *